United States Patent [19]

Todaro et al.

[11] Patent Number: 4,679,019

[45] Date of Patent: Jul. 7, 1987

[54] TRIP ACTUATOR FOR MOLDED CASE CIRCUIT BREAKERS

[75] Inventors: Frank A. Todaro, Clinton; Roger N. Castonguay; Alexander A. Krajewski, both of Terryville; Robert A. Morris, Burlington, all of Conn.

[73] Assignee: General Electric Company, New York, N.Y.

[21] Appl. No.: 862,929

[22] Filed: May 14, 1986

[51] Int. Cl.[4] ..... H01H 9/00

[52] U.S. Cl. ..... 335/172; 335/169; 335/174; 335/38

[58] Field of Search ..... 335/8, 10, 9, 21, 22, 335/35, 23, 167, 38, 168, 169, 170, 171, 172, 174

[56] References Cited

U.S. PATENT DOCUMENTS

| | | | |
|---|---|---|---|
| 3,758,887 | 9/1973 | Ellsworth | 335/8 |
| 4,346,356 | 8/1982 | Fujiwara | 335/174 |
| 4,589,942 | 5/1986 | Dougherty . | |
| 4,591,942 | 5/1986 | Willard et al. . | |

OTHER PUBLICATIONS

U.S. patent application Ser. No. 817,213, Ronald D. Ciarcia et al., "Interchangeable Mechanism For Molded Case Circuit Breaker", filed Jan. 8, 1986.

*Primary Examiner*—E. A. Goldberg
*Assistant Examiner*—L. Donovan
*Attorney, Agent, or Firm*—Richard A. Menelly; Walter C. Bernkopf; Fred Jacob

[57] ABSTRACT

An electronically driven trip actuator for multipole industrial rated molded case circuit breakers is installed within a common housing with the circuit breaker operating mechanism. The trip actuator consists of a mechanical actuator cooperatively connected with a magnetic latch. The magentic latch arrangement holds the trip actuator against an actuating spring bias. Upon receiving an appropriate signal response, the magnetic latch releases, allowing the mechanical actuator to move into contact with the circuit breaker latch under the influence of the actuator spring. The arrangement of the mechanical actuator and actuator spring provides a low latching force to the magnetic latch, while providing a large trip force to the circuit breaker latch.

19 Claims, 7 Drawing Figures

37
40
42
36
39
21
20
38
25
19B
69
10
15
22
23
32
30
19A
30A
27
24
26
28
68
33
71
29
31
35
34
18
14
41
18
16
13
12
11
43
16
17
86

TRIP ACTUATOR FOR MOLDED CASE CIRCUIT BREAKERS

BACKGROUND OF THE INVENTION

Electronic trip unit circuits fabricated by V.L.S.I. very large scale integration techniques, such as described within U.S. Pat. No. 4,589,052 to John Dougherty, entitled "Digital $I^2T$ Pick-Up, Time Bands and Timing Control Static Trip Circuit Breaker", have substantially reduced the size requirements for such electronic trip circuits. The development of laminated core current sensing transformers, such as described within U.S. Pat. No. 4,591,942 to Henry Willard et al, entitled "Current Sensing Transformer Assembly", substantially reduces the cost of high quality current sensing transformers, making such current sensing transformers economically feasible within lower ampere rated industrial molded case circuit breakers. The reduction in size of both the trip unit and current sensing transformers allows the combination to be used within a common molded case industrial circuit breaker housing.

Besides providing a wide range of time over current trip characteristics, electronic trip units further provide accessory functions. Such functions include shunt trip and undervoltage as well as zone-select interlock facility, which heretofore was provided to thermal-magnetic industrial molded case circuit breakers of lower ampere rating by separate individual accessory units.

When such electronic trip units are employed with common circuit breaker operating mechanisms, a trip force must be provided to overcome the mechanical latching forces that exist between the circuit breaker cradle and the primary latch as well as between the primary and secondary latches themselves. The latching force requirements ensure resistance against so-called "nuisance tripping" due to external environmental effects, such as shock and vibration. To overcome these latching forces, a powerful trip force is usually supplied by an electromagnetic armature held against the forward bias of a relatively heavy compression spring by the attraction of a permanent magnet. An electric current pulse to the electromagnet opposes the magnetic force of attraction and allows the armature to be driven forward under the bias of the compression spring to articulate the operating mechanism and open the breaker contacts. Since the size requirement of the permanent magnet, compression spring and the electromagnet are gauged in proportion to the latching forces, such size requirements have heretofore prevented magnetic trip actuators from being economically feasible in industrial rated molded case circuit breakers of lower ampere ratings.

The present invention provides sufficient trip force to overcome the circuit breaker latching forces by the cooperative arrangement of a compact magnetic latch and a mechanical actuator. The mechanical actuator design converts a low latching force from the magnetic latch to a high tripping force at the circuit breaker trip mechanism. The low force requirements result in the use of a compact electronic trip unit, sensing transformers and accessories within a compact molded case.

SUMMARY OF THE INVENTION

An electronically driven trip actuator comprised of a magnetic latch and a molded plastic mechanical actuator allows the use of an electronic trip unit within lower ampere rated industrial molded case circuit breakers.

The magnetic latch assembly comprises a hook-shaped latch-piece, stator and rotor pivotally arranged relative to a miniature permanent magnet. The mechanical actuator comprises a single molded plastic structure which includes a first lever in contact with the circuit breaker latch and a second lever in contact with a torsion spring. A crosspiece integrally formed within the mechanical actuator is held against the urgence of the torsion spring bias by engagement with the latch-piece of the magnetic latch assembly.

DESCRIPTION OF THE PREFERRED EMBODIMENT

Figure 1:
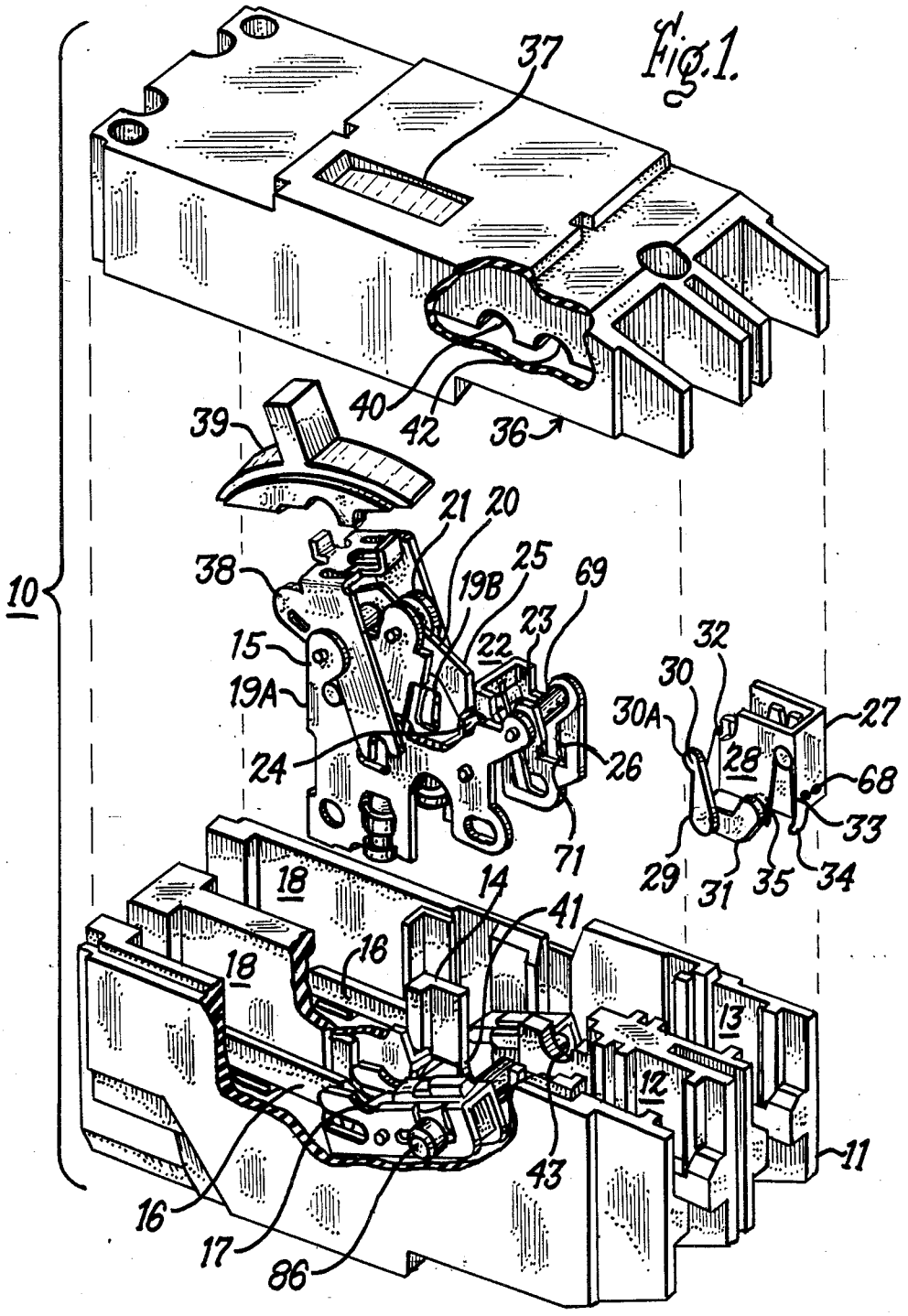
FIG. 1 is a top perspective view, in isometric projection, of a two pole molded case circuit breaker including the trip actuator according to the invention.

An industrial rated molded case circuit breaker 10 having an ampere rating of 15 to 1,200 amperes is depicted at 10 in FIG. 1, wherein a molded plastic case 11 is arranged in a two-pole configuration with a first compartment 12 and a second compartment 13 integrally formed with the case and separated from each other by means of a dividing wall 14. An operating mechanism 15 of the type described in U.S. patent application Ser. No. 817,213, filed Jan. 8, 1986, entitled "Interchangeable Mechanism For Molded Case Circuit Breaker", is mounted in the first compartment over a contact arm carrier 17 which supports a movable contact arm 16. The completely assembled circuit breaker includes a fixed contact arm and means for electrical interconnection with an external circuit and, although not shown, is completely described within the referenced U.S. patent application which should be reviewed for a better understanding thereof. The movable contact arm 16 extends within an arc chamber 18, which contains means for extinguishing an arc that occurs when the circuit breaker contacts are separated to interrupt the current through a protected circuit. The arc chute arrangement is also found within the aforementioned U.S. patent application. A similar contact arm and contact arm carrier are arranged within the second compartment 13 and are interconnected with the first movable contact arm 16 and contact arm carrier 17 by means of a crossbar 86, which extends between both compartments 12, 13 through a crossbar slot 41. When completely assembled, both contact arms move in unison under the operation of a circuit breaker handle 39 mounted to the operating mechanism 15 by means of a handle yoke assembly 38. The operating mechanism is assembled between a pair of side frames 19A, 19B, which carries an operating cradle 20 for latching the breaker contacts in a closed condition by the engagement of a cradle hook 25 with a primary latch 24 and also by means of a secondary latch 23 mounted to the operating mechanism by means of a secondary latch pivot 69. The entire latch assembly 22, consisting of the primary and secondary latches as described within the referenced U.S. patent application, further includes a trip bar 26 pivotally arranged for moving the secondary latch 23 away from the primary latch 24 to thereby allow the cradle to be released by the primary latch and move the movable contacts into an open position. The handle 39 protrudes through a slot 37 arranged through the molded cover 36, which is securely attached to the molded case 11 by means of screws or rivets (not shown). In order to operate on the secondary latch 23 directly, a trip actuator, generally indicated at 27, is arranged within the second compartment 13 such that a mechanical actuator 29, including a first pivotally mounted lever 30 and a second lever 31, is arranged within the first compartment 12 while a magnetic module 28, a torsion spring 33 and a magnetic latch-piece 32 are arranged within the second compartment 13. An end 30A of the first lever 30 is arranged for interaction with a tab 71 on the secondary latch 23, while the second lever 31 engages the torsion spring 33 by means of a protrusion 35 integrally formed on the second lever 31 for biasing the spring 33 against a stop 34 integrally formed on the exterior of the magnetic module 28, as seen by referring to FIG. 5. Electrical connection with the magnetic module components is made by a plurality of terminals 68 arranged on the exterior of the magnetic module. Electrical integrity between both poles is assured by the slots 41, 43 cooperating with corresponding slots 40, 42 formed in the cover 36, which allow the crossbar 86 and the first operating lever 30 to extend within the first compartment 12 without allowing any electrical access between the electrical components within both poles.

Figure 2:
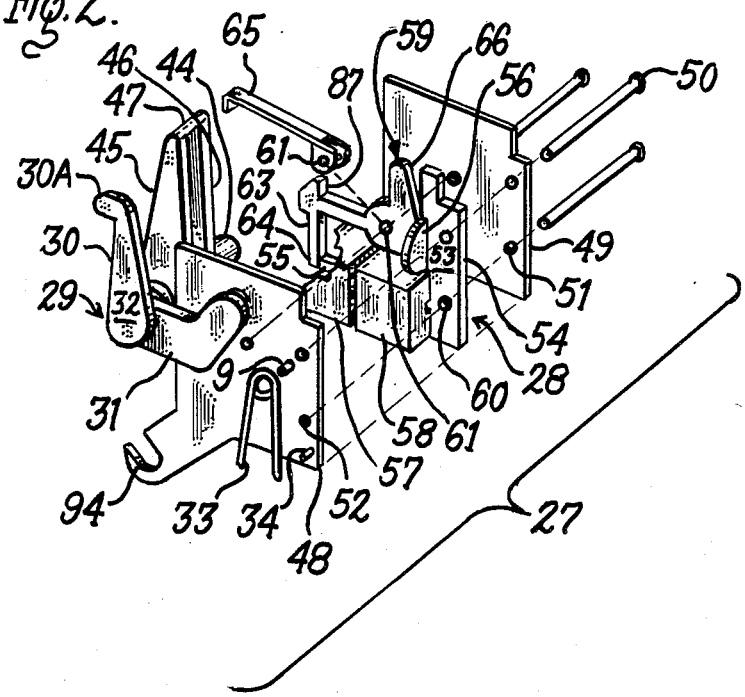
FIG. 2 is a top perspective view, in isometric projection, of the components within the trip actuator depicted in FIG. 1.

The entire trip actuator 27 is shown disassembled in FIG. 2 to illustrate the magnetic module 28 with its L-shaped stator 53 arranged with a vertical leg 54, as defined in the plane of FIG. 2, carrying an integrally formed horizontal leg 55 around which are arranged a shunt trip coil 57 and a flux shift coil 58. The shunt trip coil 57 responds to an electronic trip signal to cause the circuit breaker operating mechanism to respond and open the contacts for remote switching purposes. The flux shift coil 58 is connected with an electronic trip unit 72 which comprises an integrated circuit trip unit 72 depicted in FIG. 5. Upon the occurrence of an overcurrent condition through the protected circuit, an appropriate signal is sent to the flux shift coil to articulate the operating mechanism and trip the breaker. A rotor 59, consisting of an integrally upright arm having a downwardly extending leg member 63 and a radially formed protrusion 87, is pivotally mounted by means of a through-hole 61 extending through the rotor 59 for rotation about a pivot provided by headed bolt 50 used for assembling side frames 48, 49. A miniature permanent magnet 56 is imbedded within the vertical leg 54 for magnetic interaction with a rounded end 64 of the horizontal leg 55 by flux transfer through the upright arm 66 and thence the leg 63 of the rotor 59. The side frames 48, 49 of the magnetic module are attached together by means of the headed bolts 50 extending through clearance holes 51 formed on side frame 49, through clearance holes 60 formed within the L-shaped stator 53 and terminating within threaded holes 52 formed within the side frame 48. The torsion spring 33 is arranged on side frame 48 by means of a stud 9 located between stop 34 on the side frame and a protrusion 35 extending from the second lever 31. The magnetic latch accordingly comprises a hook-shaped latch-piece 65, pivotally attached to the upright arm 66 by means of the through-hole 61 for rotatably engaging a crosspiece 47 supported by integrally formed posts 45, 46 extending from a bar 44 integrally formed within the mechanical actuator 29. The mechanical actuator 29 accordingly comprises the first lever 30 and second lever 31 integrally formed from a single molded plastic operation and separated from each other by means of a connecting piece 81, which forms a part of the bar 44. The mechanical actuator 29 is supported on the magnetic module 28 by inserting the bar 44 integrally formed therein within the slot 94 formed in the bottom of the side frame 48. A similar slot 94 is arranged through the bottom of the other side frame 49 for supporting the opposite end of bar 44.

Figure 3:
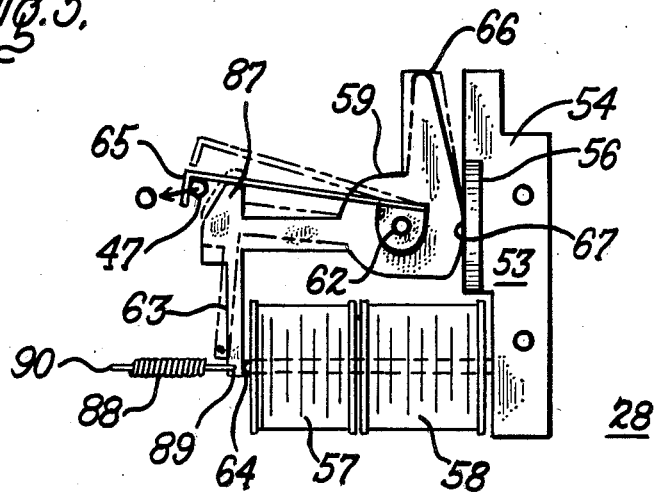
FIG. 3 a side view of the assembled trip actuator depicted in FIGS. 1 and 2.
Figure 4:
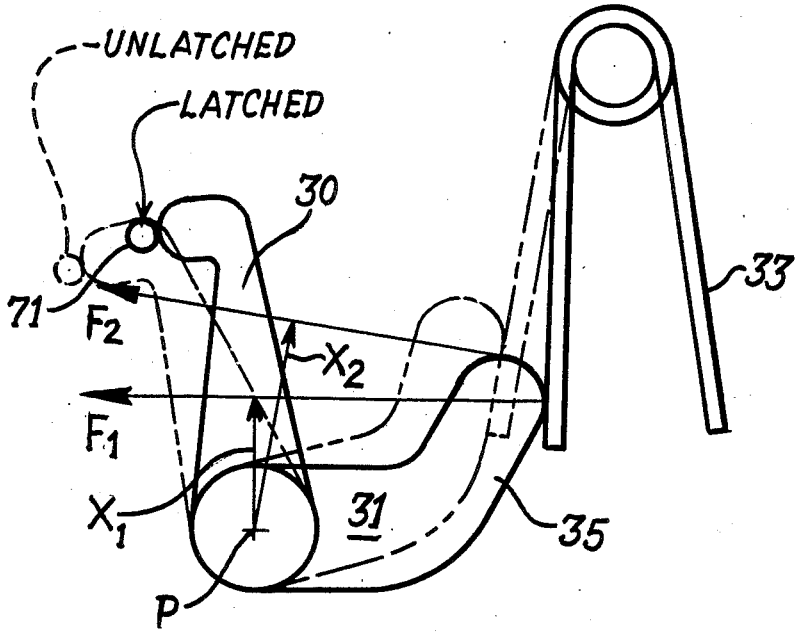
FIG. 4 is a side view of the mechanical actuator depicted in FIGS. 1 and 2.

The operation of the magnetic module 28 is now seen by referring to FIG. 3 wherein the module is depicted in solid lines magnetically latched by the capture of the crosspiece 47 under the end of the hook-shaped latch-piece 65 and is depicted in phantom in an unlatched condition. The radial surface 67 on the upright arm 66 of the rotor 59 abuts the miniature permanent magnet 56 at only one point of contact. This singular contact point is effected by the geometry of the radial surface 67 such that the magnetic attraction on either side of the point of contact is evenly distributed. The magnetic flux is carried through the rotor 59 from the point of contact on the upright arm down through the leg 63 to the rounded end 64 of the horizontal leg 55 formed on the L-shaped stator 53 to complete the magnetic path back to the miniature permanent magnet 56. The rounded end 64 ensures a single point of contact in a manner similar to the radial surface 67. A small trip spring 88 is secured to one end of leg 63 by means of a hole 89 and is attached to the outer cover (not shown) of the magnetic module 28 by means of a hooked end 90. The magnetic flux from the miniature permanent magnet 56 holds the rotor 59 from rotating in a clockwise direction against the bias of the trip spring 88. When a signal is applied to the flux shift coil 58, the magnetic field induced therein opposes the flux produced within the horizontal leg 55 by the permanent magnet, thereby allowing the rotor 59 to rotate and carry the radial protrusion 87 into contact with the hook-shaped latch-piece driving the hook-shaped latch-piece 65 to the position indicated in phantom and allowing the crosspiece 47 to move forward under the influence of the torsion spring 33, as best seen by referring now to FIG. 4.

The torsion spring 33 is fixedly held against the stop 34 on the trip actuator 27 at one leg, as described earlier with reference to FIG. 1, while the opposite leg abuts against the protrusion 35 on the second lever 31. When the trip actuator 27 is in the latched position, as indicated in phantom in FIG. 4, the torsion spring 33 exhibits a force $F_1$ in the indicated direction on the second lever 31, resulting in a first torque $(F_1)(X_1)$ on the second lever rotating the lever about its pivot P measured at a distance $X_1$ from the pivot P. When the magnetic latch releases, thereby allowing the first and second levers 30, 31 to rotate in the counterclockwise direction about the pivot P, the torsion spring 33 exhibits a force $F_2$ in the indicated direction which slightly decreases in magnitude as the torsion spring 33 proceeds to move from the magnetically latched to the magnetically unlatched position indicated in solid lines. $F_2$ is applied at a second distance $X_2$ from the pivot P to produce a torque $(F_2)(X_2)$, which is substantially greater than the first torque. The increase in torque results primarily from the increase in the length of the distance $X_2$ over the distance $X_1$. The resultant force delivered to the extension 71 of the secondary latch 23 correspondingly increases in magnitude, moving from the magnetically latched to the magnetically unlatched position. The arrangement of the first and second levers 30, 31 at predetermined distances $X_1$, $X_2$ is an important feature of the instant invention. This arrangement provides a small "latching" force of a few ounces in magnitude against the second leYer that is much lower than the available magnetic force generated by the miniature permanent magnet 56 (FIG. 3), while providing a resulting tripping force on the secondary latch extension in the order of several pounds. The larger tripping force is required to overcome the circuit breaker latching forces which are applied to the secondary latch extension 71 within the circuit breaker operating mechanism 15 shown in FIG. 1.

Figure 5:
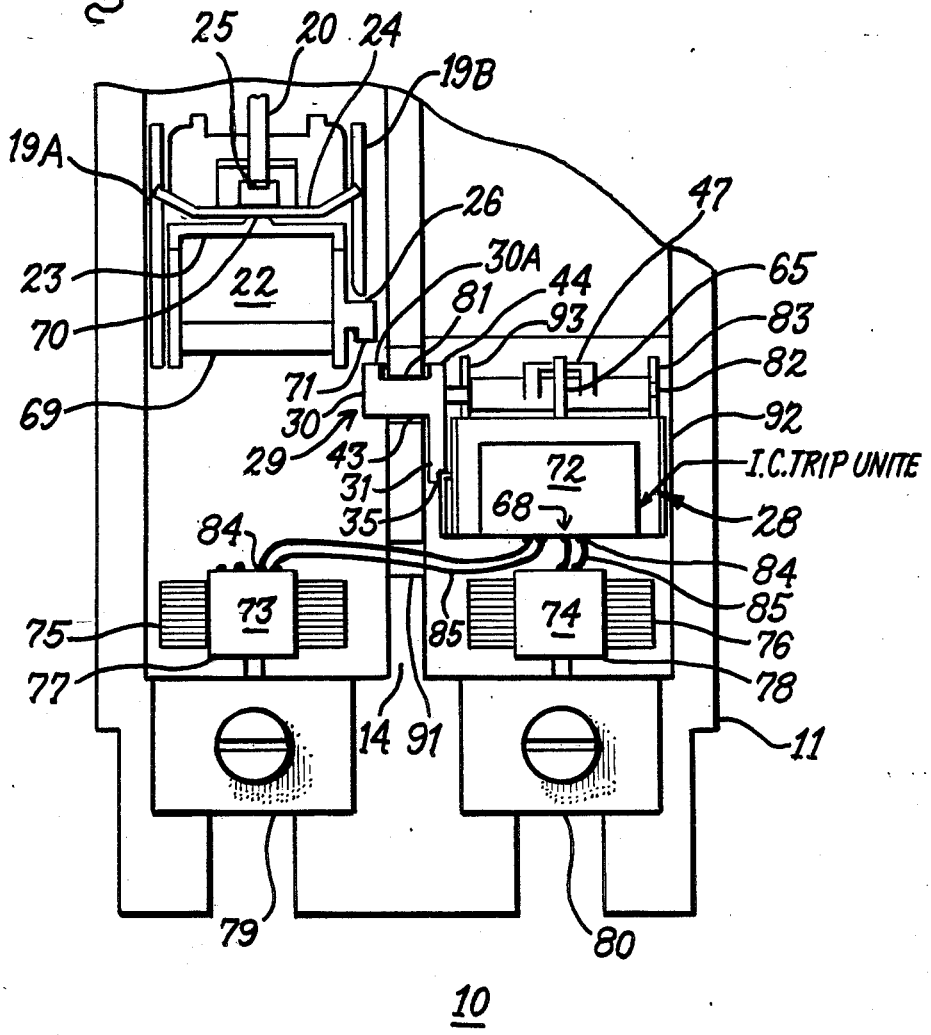
FIG. 5 is a plan view of the circuit breaker of FIG. 1 after assembly of the breaker components.

The two-pole breaker 10 is shown in FIG. 5 with the cover removed and with the electronic components assembled for providing the necessary trip logic to the magnetic module 28. The current applied to the load side of the breaker overload straps 79, 81 is sensed through both poles by means of current transformers 73, 74, which include cores 75, 76 and secondary windings 77 and 78 respectively. The sensed current from the secondary windings is directed from terminal pins 84 and wires 85 to corresponding terminals 68 on the integrated circuit trip unit 72 for processing. The wires 85 interconnect between the two poles through an access slot 91 formed within the center wall 14 of the breaker case 11. Upon determination of an overload condition, an output signal from the trip unit is fed to the magnetic module 28, which is interconnected with the trip unit by means of terminals 68. The mechanical actuator assembly 29 is arranged within the circuit breaker case 11 such that the end 82 of the integrally formed bar 44 is rotatably supported within an opening 83 formed in the magnetic module enclosure 92 at one end, while being rotatably supported at an opposite end by the connecting piece 81 which nests in a corresponding opening 93 formed in the opposite end of the enclosure. Upon receiving a trip signal from the trip unit, the magnetic module 28 releases the hook-shaped latch-piece 65 from crosspiece 47 on the mechanical actuator 29, thereby allowing the torsion spring 33 abutting against the protrusion 35 on the second lever 31 to drive the lever counterclockwise as viewed in FIG. 4, thereby rotating the first lever 30 and driving the contact end 30A against a trip tab 71, which is an extension of the circuit breaker secondary latch 23. The secondary latch 23 then becomes displaced thereby allowing a boss 70 on the secondary latch 23 to move out of the path of the primary latch 24, sequentially allowing the cradle hook 25 to become released from the primary latch 24. The cradle 20 rapidly rotates in the manner described within the referenced U.S. patent application to allow the operating circuit breaker operating springs shown therein to separate the contacts and interrupt the circuit current. Still referring to FIG. 5, the breaker is reset by engaging the cradle hook 25 with the primary latch 24, bringing the secondary latch 23 and the trip tab 71 on the secondary latch 23 against the contact end 30A of the primary lever 30 and rotating the primary lever from the position indicated in solid lines in FIG. 4 to the latched position indicated in phantom.

Figure 6:
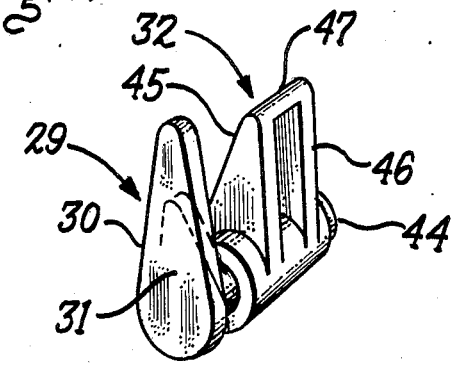
FIG. 6 is perspective view of an alternate mechanical trip actuater used within the trip actuator according to the invention.

An alternate mechanical actuator 29 formed from a single molded plastic composition is depicted in FIG. 6, wherein the second lever 31 is located in the same plane as the primary lever 30 but is offset a slight distance d (FIG. 7) from a center line through the center of the primary lever to enable the torsion spring 33 to rotate the actuator about its pivot P. The magnetic latch 32 is similar to that described earlier and comprises a pair of posts 45, 46 extending from a bar 44 and connected by means of a crosspiece 47.

Figure 7:
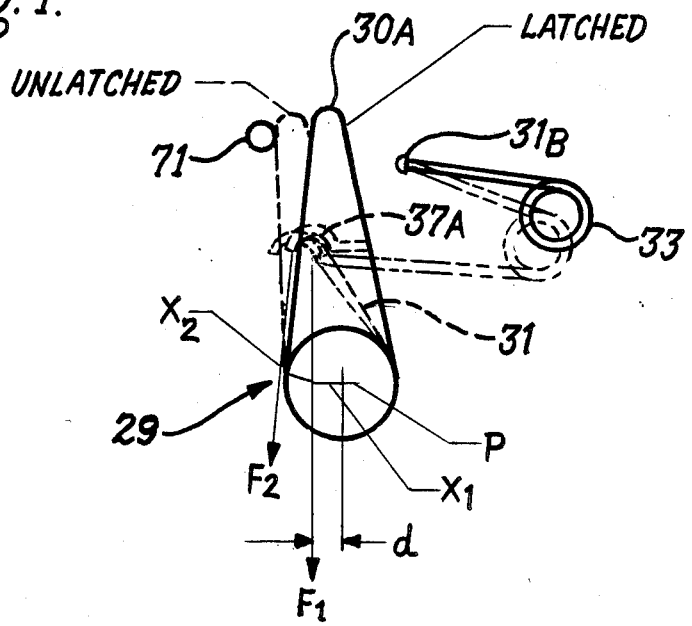
FIG. 7 is a side view of the alternate mechanical actuator depicted in FIG. 6.

Referring now to FIG. 7, the torsion spring 33 contacts the second lever 31 by means of a hooked-end 37A and is anchored to the enclosure (not shown) at its opposite end 31B. In a similar manner as shown earlier with reference to FIG. 4, the torsion spring exhibits a first force $F_1$ in the indicated direction on the second lever and generates a torque at a first distance $X_1$ measured from the pivot P. This first force $F_1$ comprises the latching force described earlier. When the trip actuator becomes unlatched, the torsion spring exerts a force $F_2$ in the indicated direction, which provides a torque on the second lever 31 at a distance $X_2$ from the pivot P. When the contact end 30A of the first lever 31 rotates into contact with the trip tab 71, a force of several pounds is generated in the movement of the primary lever 30 from the latched to the unlatched position. It is noted that the torsion spring 33 also moves with the second lever 31 and substantially reduces any friction forces which would otherwise exist between the spring end 37A and the second lever 31 if the torsion spring 33 should remain motionless. The low friction arrangement between the torsion spring and the second lever is an important feature of this trip actuator design, since it allows this trip actuator to rotate at a faster rate than the one depicted in FIG. 4.

It has thus been shown that a trip actuator comprised of a unitary mechanical actuator and a magnetic module efficiently transfers the electronic trip logic from an electronic trip unit to mechanical motion for articulating a circuit breaker operating mechanism when arranged within a molded case circuit breaker enclosure. The arrangement of the trip actuator in an outside pole compartment of a multi-pole breaker prevents dielectric failure between the poles. The particular arrangement of a torsion spring and mechanical actuator results in a high spring force with a low torque on the mechanical actuator in a magnetically latched position and a low spring force with a high torque applied to the mechanical actuator when the magnetic module is magnetically unlatched. This results in the application of an increasing tripping force against the secondary latch to articulate the circuit breaker operating mechanism. After the circuit breaker mechanism has tripped, the arrangement of the torsion spring and mechanical actuator advantageously allows the mechanical actuator to be reset against a decreasing reset force.

Having thus described our invention, what we claim as new and desire to secure by Letters Patent is:

1. A molded case circuit breaker comprising:

an insulative case containing a pair of separable contacts operatively connected with an operating mechanism for opening and closing said contacts;

a circuit breaker latch at a first location within said mechanism for holding said contacts closed against the bias of an over-center operating spring;

a trip actuator comprising a first and a second lever arranged for rotation about a common pivot under the urgence of an actuator spring, said first lever arranged for contacting said circuit breaker latch to displace said circuit breaker latch to a second location thereby articulating said operating mechanism and causing said contacts to open under urgence of said operating spring, said second lever abutting said actuator spring;

a crosspiece attached to said first and second levers for engagement with a latch-piece to retain said first and second levers from rotation against the bias of said actuator spring; and a magnetic module operatively connected with said latch-piece for moving said latch-piece out of engagement with said crosspiece thereby allowing said first and second levers to rotate under the urgence of said actuator spring.

2. The molded case circuit breaker of claim 1 wherein said actuator spring generates a first force on said first and second levers at a first distance from said pivot to provide a first torque on said trip actuator; and said actuator spring generates a second force on said first and second levers at a second distance from said pivot to provide a second torque on said trip actuator, said second torque being greater than said first torque to accelerate rotation of said trip actuator into contact with said circuit breaker latch.

3. The molded case circuit breaker of claim 1 wherein said actuator spring comprises a body member terminating in first and second legs, said first leg abutting said second lever and said second leg abutting a rigid stop member.

4. The molded case circuit breaker of claim 1 wherein said second lever is offset from a centerline along a major length of said first lever.

5. The molded case circuit breaker of claim 1 wherein said first and second levers radiate from an integrally-formed shaft extending in a first plane perpendicular to said first and second levers.

6. The molded case circuit breaker of claim 5 including a pair of posts extending from said shaft, said crosspiece extending between adjacent ends of said posts.

7. The molded case circuit breaker of claim 1 wherein said magnetic module comprises an L-shaped metallic stator member having a permanent magnet attached to a first leg for generating a magnetic flux and a pair of electrical coils around a second leg for generating an opposing magnetic flux to cancel said permanent magnet magnetic flux.

8. The molded case circuit breaker of claim 7 wherein said magnetic module includes a rotatably mounted metallic rotor member having a first leg abutting said stator second leg to prevent said rotor from rotation in a clockwise direction against the bias of a trip spring by influence of said permanent magnet magnetic flux.

9. The molded case circuit breaker of claim 8 wherein said magnetic flux is cancelled by an opposing magnetic flux generated within said second leg of said stator member by excitation of either said first or second electrical coil.

10. The molded case circuit breaker of claim 8 further including a second leg on said rotor member integrally formed with said first leg and abutting said permanent magnet to further prevent said rotor member from rotation in a clockwise direction.

11. The molded case circuit breaker of claim 10 further including a latch-piece pivotally attached to said magnetic module at one end and having a hooked extension at an opposite end arranged for engaging said crosspiece.

12. The molded case circuit breaker of claim 11 wherein said second leg of said rotor member includes a radial protrusion extending from said second leg and arranged for contacting said latch-piece and moving said latch-piece hooked extension out of engagement with said crosspiece upon clockwise rotation of said second leg to allow said first and second levers to rotate in a counter-clockwise direction about said common pivot.

13. The molded case circuit breaker of claim 1 further including a pair of first and second side frames for supporting said magnetic module and said actuator spring.

14. The molded case circuit breaker of claim 13 wherein said actuator spring comprises a body member terminating in first and second legs, said first leg being attached to said second member and said second leg being fixedly retained by one of said side frames whereby said body member moves relative to said first side frame when said first and second levers rotate about said pivot.

15. A multi-pole electronic circuit breaker comprising:

a partitioned molded plastic case comprising a first and a second compartment including first and second pairs of separable contacts under control of a common operating mechanism;

a partitioned molded plastic cover comprising complementary first and second compartments for overlaying said first and second case compartments;

a pair of current sensing transformers one in each of said first and second case compartments for electrical connection with an external protected circuit;

an electronic trip unit connected with said current transformers for determining an overcurrent condition through said protected circuit and providing a trip output signal upon occurrance of said overcurrent;

a trip actuator within said first compartment and having an operating lever extending within said second compartment for articulating said operating mechanism to open said first and second pairs of separable contacts upon occurrance of said overcurrent;

a magnetic module within said first compartment comprising a rotor and stator, said stator including a permanent magnet attached thereto, said rotor being retained from rotation against the bias of a trip spring by abutment with said stator and by influence of magnetic flux generated by said permanent magnet, said stator further including an electric trip coil arranged around a first leg; and said trip actuator operating lever being retained from rotating against the bias of an actuator spring by contact between a crosspiece on said operating lever and a latch-piece on said magnetic module, said latch-piece being arranged for contact with said stator when said trip output signal is applied to said electric coil whereby said electric coil generates an opposing magnetic flux within said stator first leg to cancel said permanent magnet magnetic flux thereby allowing said rotor to move said latch-piece out of contact with said crosspiece.

16. The multi-pole electronic circuit breaker of claim 15 including an electric auxiliary coil around said stator first leg for supplying an auxiliary trip signal to said auxiliary coil whereby said auxiliary coil generates an auxiliary opposing magnetic flux within said stator first leg to cancel said permanent magnet magnetic flux, thereby allowing said rotor to move said latch-piece out of contact with said crosspiece to allow said trip actuating lever to articulate said operating mechanism to open said first and second pairs of operable contacts in the absence of said overcurrent conditions.

17. The multi-pole electronic circuit breaker of claim 15 wherein said cover includes a separation wall between said first and second compartments, said separation wall including a semicircular slot between said first and second compartments in said case whereby said operating lever extends from said first to said second compartment within an opening through both said first and said second compartments in said cover and case defined by both said semicircular slots.

18. A trip actuator for molded case circuit breakers comprising:

a mechanical actuator having first and second lever arms arranged for rotation about a common pivot;

an actuator spring having a central body portion terminating in a first and a second leg, said second leg being retained against a fixed stop and said first leg contacting said second lever for rotating said trip actuator about said pivot;

a crosspiece attached to said mechanical actuator for retaining said mechanical actuator against rotation by said actuator spring;

a magnetic module comprising a fixed metallic L-shaped stator having first and second orthogonal legs with a permanent magnet attached to said first leg and an electromagnetic coil arranged around said second leg, a magnetic L-shaped rotor having first and second orthogonal legs pivotally arranged for rotation against the bias of a trip spring attached to said rotor second leg, said rotor first leg abutting said permanent magnet for providing a magnetic force on said rotor to retain said rotor from rotation against the bias of said trip spring; and a hook-shaped latch-plate rotatably mounted on said magnetic module and arranged for engaging said crosspiece, said latch-piece being rotated away from said crosspiece to release said mechanical actuator and allow said mechanical actuator to rotate under the urgence of said actuator spring when a current pulse is applied to said electromagnetic coil to induce a magnetic force within said stator second leg in opposition to said permanent magnet magnetic force and thereby allow said rotor to rotate under the urgence of said trip spring.

19. The trip actuator for molded case circuit breakers of claim 18 wherein said first and second lever arms and said crosspiece are integrally formed from a unitary plastic composition.

* * * * *